US006772452B1

(12) United States Patent
Miller et al.

(10) Patent No.: US 6,772,452 B1
(45) Date of Patent: Aug. 10, 2004

(54) LAMINAR FLOW ATTACHMENT FOR CONTROLLING TOILET BOWL SPLASHING

(76) Inventors: H. Richard Miller, 3711 55th Ave. SW., Seattle, WA (US) 98116; Robert Miller, 15946 Mariner Dr.92649, Huntington Beach, CA (US) 92649

( * ) Notice: Subject to any disclaimer, the term of this patent is extended or adjusted under 35 U.S.C. 154(b) by 0 days.

(21) Appl. No.: 10/430,618

(22) Filed: May 7, 2003

(51) Int. Cl.[7] ..... A47K 13/10

(52) U.S. Cl. ..... 4/246.1; 4/246.2; 4/250; 4/249

(58) Field of Search ..... 4/246.1, 246.2, 4/408, 407, 409, 330, 335, 338, 436, 249, 250, 241, 422, 423

(56) References Cited

U.S. PATENT DOCUMENTS 346,997 A * 8/1886 Hunter ..... 4/349
785,729 A * 3/1905 Gillin ..... 251/17
1,081,448 A * 12/1913 Hunt ..... 4/266
1,301,188 A * 4/1919 Stark ..... 4/335
1,985,120 A * 12/1934 Vogel ..... 4/423
4,766,619 A * 8/1988 Takeda ..... 4/246.1
6,438,764 B1 * 8/2002 Andersen ..... 4/246.1

* cited by examiner

*Primary Examiner*—Gregory L. Huson
*Assistant Examiner*—Khoa Huynh
(74) *Attorney, Agent, or Firm*—I. Michael Bak-Boychuk

(57) ABSTRACT

An assembly useful in directing a stream of water onto the surfaces of a toilet bowl includes a delay valve rendered operative by the lifting of the toilet seat and a bellows spring connected to be pulled in by the latching vacuum draw of the delay valve and thereafter released to displace the seat towards its lowered state. A set of springs then opposes the dropping stroke of the seat once displaced by the bellows spring. The assembly is conformed for installation onto an existing toilet.

10 Claims, 2 Drawing Sheets

LAMINAR FLOW ATTACHMENT FOR CONTROLLING TOILET BOWL SPLASHING

BACKGROUND OF THE INVENTION

1. Field of the Invention

The present invention relates to toilet bowl devices and more particularly to an auxiliary water flow structure for producing a laminar flow sheet on the bowl surface that is rendered operative in conjunction with the articulation of the toilet seat.

2. Description of the Prior Art

In a typical household there are few physical structures that accommodate or distinguish between the male and female anatomy of the occupants, the accommodation of the anatomical differences being mostly focused in the structure of a toilet. To resolve this differentiation in use the typical household toilet includes a pivoted seat that is often manually raised by the male as a courtesy to those that may follow, thus moving the seat surface away from any incident backsplash. The articulated seat, however, is then frequently left in its upright position and this inattention, itself, often rises to the level of a constant irritant and a source of dispute.

In the past various devices have been proposed which in one way or another lower the toilet seat after a time period expires after it has been raised. Examples of such devices can be found in the teachings of U.S. Pat. No. 5,488,744 to Paananen; U.S. Pat. No. 5,742,949 to Golgi, et al.; U.S. Pat. No. 6,035,454 to Birchall; and others. While suitable in resolving these pervasive inattention disputes, and thus for the purposes intended, these teachings do not address, nor do they contemplate, the other subsidiary household disputes about those parts of the backsplash that fall outside the confines of the toilet bowl. Simply, the statistical distribution of splashing during the course of male urination extends beyond the toilet bowl periphery and the articulated seat courtesy therefore attends to only one part of the problem. Also needed are techniques and devices that modify backsplash kinematics to the confines of the bowl. Devices that concurrently control the backsplash trajectory while also automatically attending to the seat lowering courtesy are therefore extensively desired and it is one such device that is disclosed herein.

SUMMARY OF THE INVENTION

Accordingly, it is the general purpose and object of the present invention to provide a seat lowering mechanism effected by a water stream that also produces a laminar flow over the interior surfaces of a toilet bowl.

Other objects of the invention are to provide a hydraulic actuator for an articulated toilet seat that also produces a laminar fluid flow sheet on the surfaces of a toilet bowl.

Further objects of the invention are to provide a water flow operated toilet seat lowering device which also is useful to produce a laminar flow over the interior bowl surfaces.

Yet additional objects of the invention are to provide an structure for producing a backsplash controlling surface flow in a toilet bowl that cooperates with an automated sequence of seat lowering.

Briefly, these and other objects are accomplished within the present invention by providing an air filled bellows spring mounted to oppose the articulation of a toilet seat, the bellows spring being connected with, and forming a common cavity with, the vacuum chamber of a conventional delay valve also mounted to be initiated by the pivoting of the seat. Thus once the seat is raised the resulting flow through the delay valve creates a partial vacuum therein, latching the delay valve to an open (on) state and also latching the bellows spring to its pulled in position. In this state the flow output from the delay valve is directed through an exit port aligned along the interior bowl surface, forming a laminar flow surface that modifies the net rebound kinematics of any flow associated with male urination. When, however, this water flow ends by the vacuum breaking timing mechanism customarily provided the spring bellows is free to vent releasing its opposing bias to displace the seat from its vertical equilibrium which then allows the seat to drop against the spring bias of two balance springs that control the seat return articulation.

Preferably, the delay period of the delay valve is selected to span a time interval that is greater than the typical interval of male urination, e.g., a minute or less, during which the water flow is directed tangentially onto the bowl surface to create a circular flow sheet therein. This circulating water flow sheet provides a tangential velocity component to any urination stream that may merge therewith, thereby limiting the kinematics of any backsplash to a dominantly tangential path. The circulating flow sheet, moreover, assists in maintaining a high level of cleanliness within the bowl thus further enhancing the utility of the instant invention These functions can be conveniently implemented by commercially available devices with the lifting articulation of the seat providing the necessary sequence initiation.

Those skilled in the art will appreciate that the circulation in a toilet bowl includes a component that is determined by the rotation of the Earth. Water conservation interests, in turn, require that the sheet flow be minimized. To optimize the benefit of the laminar sheet flow the tangential velocity thereof can be enhanced by selecting the exit flow alignment according to each hemisphere, conveniently effected by selecting the direction of a pivotal exit port in the form of a convolved exit pipe segment that is releasably connected to the delay valve. In this manner the orientation selection of a single element is utilized to expand the utility of the whole assembly.

It will be appreciated that toilet bowls with very little exception include an interior surface that promotes good surface flows towards the drain opening. This geometry compensates for the drag losses of the laminar sheet flow developed herein and as the flow rates drop off due to surface expansion the loss is then compensated by the gravitational effects. A simple, low volume water flow source is thus rendered effective over the whole of the bowl surface to alter the backsplash trajectory throughout the bowl.

DESCRIPTION OF THE PREFERRED EMBODIMENT

Figure 5:
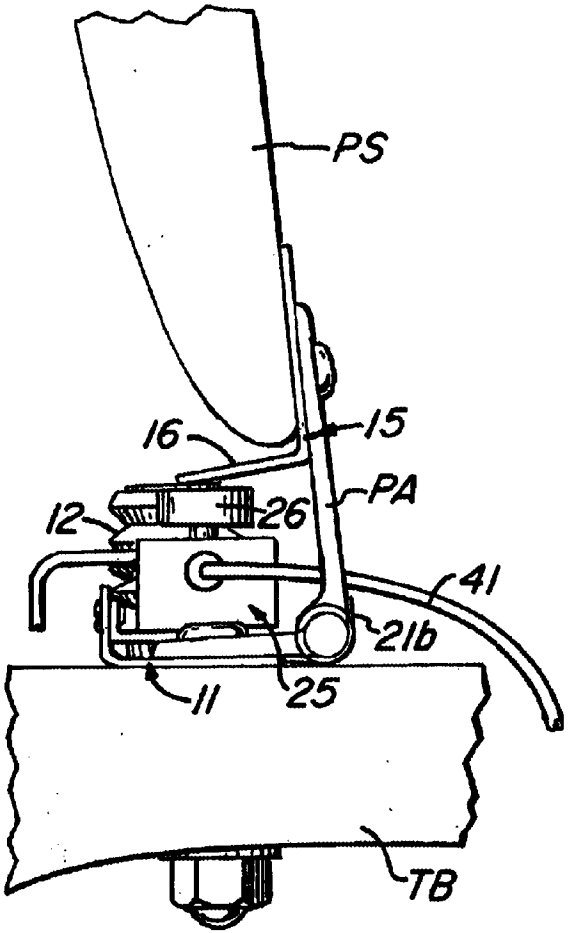
FIG. 5 is a side view detail of the toilet bowl implemented with the inventive water flow system.
Figure 1:
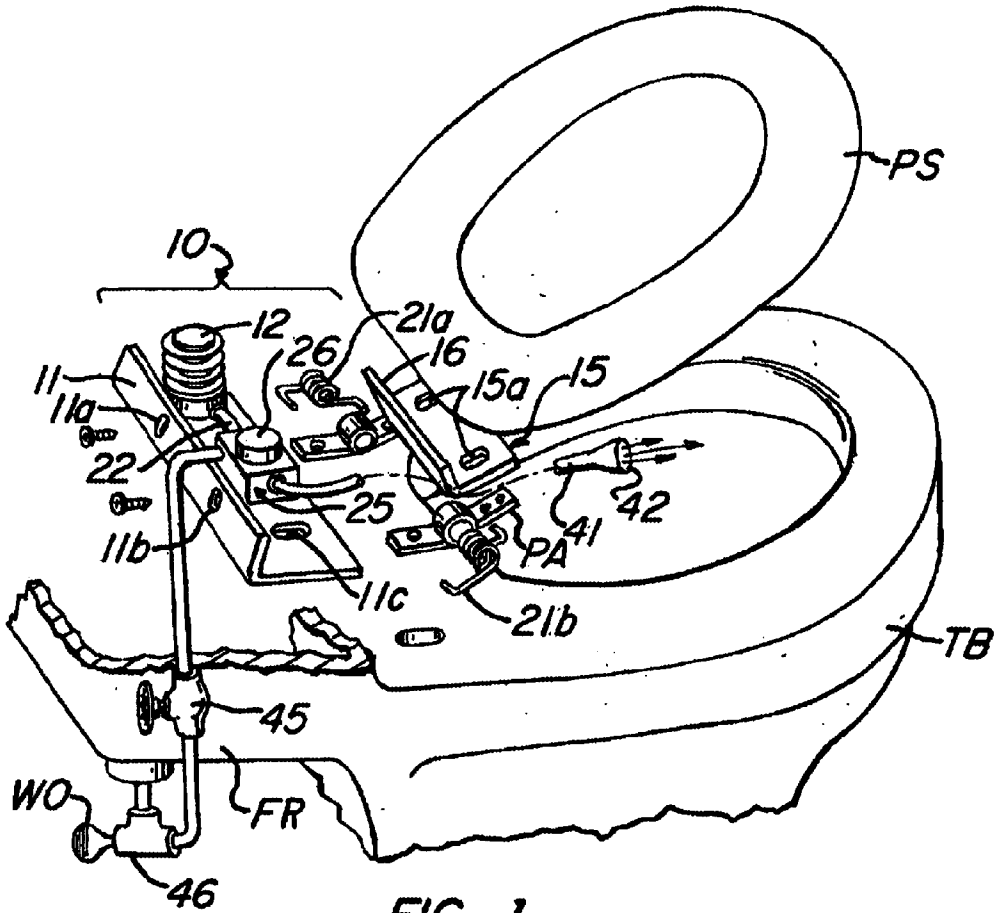
FIG. 1 is a perspective illustration, separated by parts, of a conventional toilet seat provided with the inventive water flow system rendered operative by the articulation thereof.

As shown in FIGS. 1–5, the inventive water flow system, generally designated by the numeral 10, comprises a conventional toilet bowl TB provided with its flushing reservoir FR supplied with pressurized water from a wall (or floor) mounted water outlet WO. In typical practice toilet bowl TB is further provided with a pivotally mounted seat PS mounted on a hinge or pivot assembly PA at the rear of the bowl opening adjacent the reservoir FR. It is this seat PS that is usually raised to a vertical alignment adjacent the reservoir by the male user of the toilet during urination, and while this courtesy is often practiced lowering the seat is less than consistent along with the inherent rebound dynamics of the stream that often cause unwanted splatter outside the confines of the toilet bowl. It is these two courtesies that are resolved herein.

More precisely, the inventive water flow system 10 is conformed as an aftermarket installation to be mounted on an offset bracket or strap 11 conformed to match the fastener pattern of the seat pivot assembly PA and is thus fixed in a sandwiched arrangement between the pivot assembly PA and the corresponding toilet bowl surface. In this position offset bracket 11 is useful to mount a bellows spring 12 and a conventional delay valve 25 next to each other, in a vertical alignment subjacent the plane of the pivotally lifted toilet seat PS. At the same time an angled piece 15 is secured to the underside of seat PS, again along and adjacent the pivot assembly PA, to pivotally advance a cantilevered panel 16 against the bellows spring 12 and the manual selector 26 usually provided with delay valve 25 to set off its operation, the selector 26 being thus aligned for articulation when the seat is lifted. Of course, adjustment is provided to effect these pivotal contacts only when the seat is raised beyond its vertical position, by way of slotted fastener openings 15*a* in the angled piece 15 and also by adjustable mountings 11*a* and 11*b* attaching the bellows spring 12 and the delay valve 25 and by slotting the pivot assembly openings 11*c* in bracket 11 as well. Additionally a set of helical helper springs 21*a* and 21*b* is installed at both the pivots of pivot assembly PA to oppose the return motion of the seat.

Those skilled in the art will appreciate that while in small variations conventional delay valves may be variously implemented the typical configuration of delay valve 25, like that sold by the Sloan Company under the model or style 'Flushometer' or that sold by the China Winds Group under the model no 3812, is characterized by a flow control chamber 27 connected to the water outlet WO and controlled either by the vacuum displacement of a diaphragm 28 or by the selector 26 to open the water flow passage through a venturi 29. Once this flow starts the lower venturi pressure pulls a partial vacuum in a vacuum chamber 31 to displace diaphragm 28 and thereby latch the valve to its open state. A controllable part of the flow is then diverted to a vacuum breaker chamber 32 and it is this diverted flow rate that determines the duration of the flow.

In accordance with the present invention the foregoing conventional delay valve is modified to include a port in the vacuum chamber 31 to which a tubing segment 22 is connected, segment 22 communicating at its other end with bellows spring 12. Thus once the seat PS is lifted to its over-center position, depressing bellows spring 12 and at the end articulating selector 26, the vacuum drawn in the common cavities below diaphragm 28 and bellows spring 12 keeps the spring pulled in until the delay limit is reached and the vacuum is broken. At that point the interior of the bellows is vented through the venturi 29 to atmospheric pressure, pushing seat PS back across its neutral point from where it then falls against the opposing springs 21*a* and 21*b*. In this manner a timed stream of water is provided while the seat is upright which, on its termination, initiates the lowering of the seal This stream of water may be directed into the interior of bowl TB by way of a further tubing segment 41 connected to the outlet of the venturi 29 and convolved to pass under seat PS into the bowl interior where the tubing end is collapsed to form a transverse end slot 42 that is tangentially aligned along the interior bowl surface.

Those skilled in the art will appreciate that the foregoing assembly may be easily installed onto existing toilet structures with minimal modifications. For example, the water source itself may be obtained from a tee connection 46 installed into the conventionally provided conveyance tube CT extending from the outlet WO to the reservoir and two forms of the tubing segment 41 may be provided to accommodate use in both the Northern and Southern hemispheres. The triggering point of the selector 26 can similarly be adjusted to be just beyond the upright seat alignment, thereby accommodating various seat structures and weights.

Figure 4:
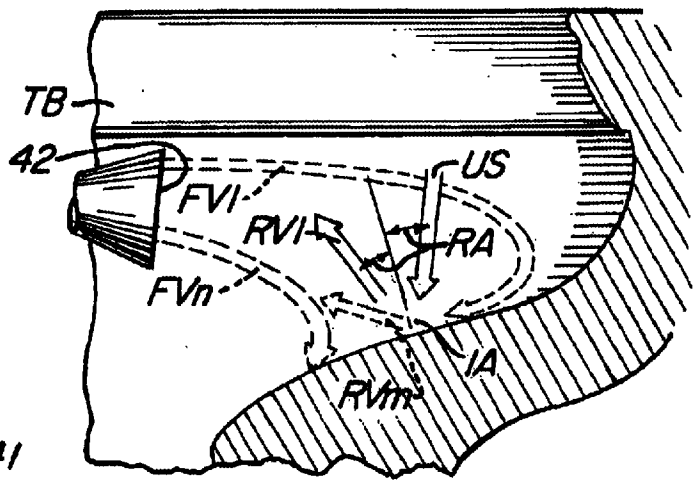
FIG. 4 is a vector diagram illustrating the energy vector contribution to the net reflected vector from the sheet water flow in accordance with the present invention.
Figure 2:
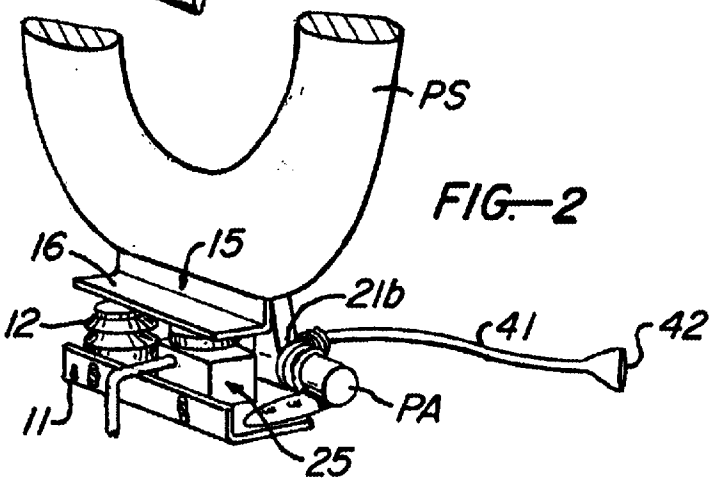
FIG. 2 is yet another perspective illustration of a toilet bowl implemented with the inventive water flow system described herein.
Figure 3:
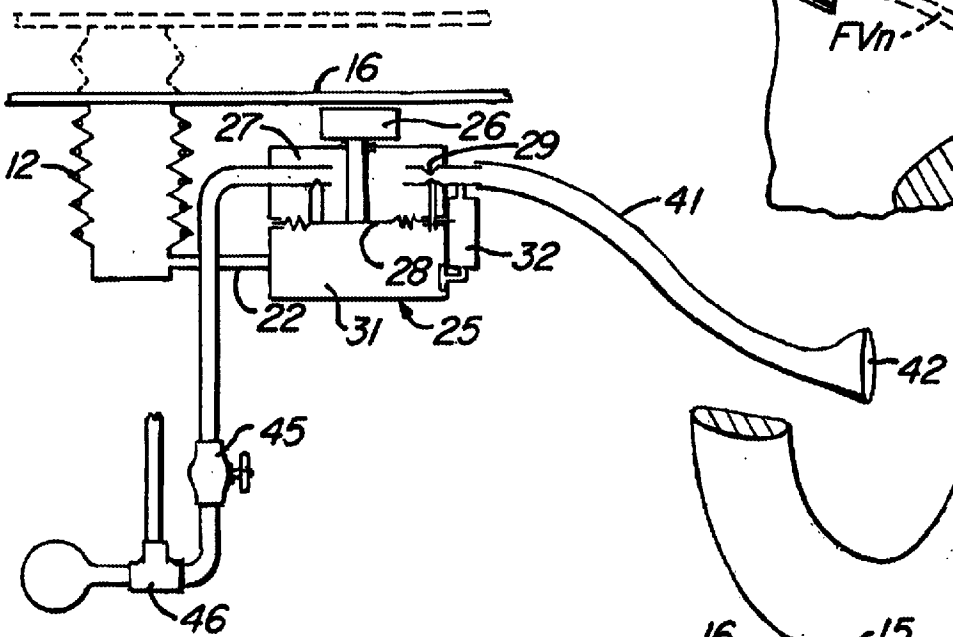
FIG. 3 is a diagrammatic illustration of the water flow system in accordance with the present invention.

In this manner a laminar flow sheet is formed over the interior surfaces of the toilet bowl which both cleans the surfaces and also produces a gradient of flow vectors FV1 through FVn that are all tangential to the local surface in a descending spiral towards the bottom of the bowl. Referring in particular to FIG. 4 the normal rebound angle RA shown as a set of vectors RV1 through RVm are each substantially equal, but opposite, to the incidence angle IA of the urination stream US and with some frequency the rebound trajectories resulting from vectors RV1–RVm extend beyond the bowl. This rebound pattern is inventively modified herein by the addition of the flow vectors FV1–FVn and by a simple adjustment of a control valve 45 on the conveyance tube CT the level of this laminar flow can be raised to a point where virtually all backsplash is eliminated. In this manner a conveniently mounted modification is obtained which eliminates virtually all arguments concerning the courtesies of shared toiled use.

Obviously, many modifications and variations can be effected without departing from the spirit of the invention instantly taught It is therefore intended that the scope of the invention be determined solely by the claims appended hereto.

What is claimed is:

1. In a delay valve including a flow control chamber connected to a source of water at pressure for selectively conveying said water, a vacuum chamber rendered operative upon the conveyance of said water through said flow control chamber, a diaphragm responsive to a selector and to said vacuum chamber and connected to said flow control chamber for initiating said conveyance of said water and for maintaining said conveyance of said water through said flow control chamber and a vacuum breaker chamber for venting said vacuum chamber upon the conveyance of a predetermined quantity of said water, the improvement comprising:

a bellows spring connected to said vacuum chamber via a port;

an angle piece adjustably engage said delay valve and said bellows spring in an alignment subjacent the pivotal articulation of a toilet seat mounted on a toilet bowl, whereby said articulation of said toilet seat beyond a vertical position relative to said bowl causes said angle piece to contact said selector and said bellows spring; and activates said conveyance of said water and a tubing segment connected to one end of said flow control chamber and aligned in said bowl for directing said conveyance of water tangentially onto the surface of said bowl.

2. Apparatus according to claim 1, further comprising:

at least one spring connected to said toilet seat for opposing the return pivotal motion thereof onto said bowl.

3. Apparatus according to claim 2, wherein:

said bellows spring is mounted to displace said seat from vertical upon the venting thereof.

4. Apparatus according to claim 3, wherein:

angle piece is deployed to oppose the extension of said bellows spring upon the venting thereof when said seat is raised to said vertical position.

5. An assembly useful for installation onto a toilet bowl provided with a pivotal toilet seat, comprising:

a source of water at pressure;

a delay valve characterized by a flow control chamber connected to said source of water at pressure for selectively conveying said water, a vacuum chamber rendered operative upon the conveyance of said water through said flow control chamber, a diaphragm responsive to a selector and to said vacuum chamber and connected to said flow control chamber for initiating said conveyance of said water and for maintaining said conveyance of said water through said flow control chamber and a vacuum breaker chamber for venting said vacuum chamber upon the conveyance of a predetermined quantity of said water;

a bellows spring connected to said vacuum chamber via a port;

an angle piece adjustably engage said delay valve and said bellows spring in an alignment subjacent the pivotal articulation of said toilet seat relative said toilet bowl, whereby said articulation of said toilet seat beyond a vertical position relative to said bowl causes said angle piece to contact said selector and said bellows spring; and activates said conveyance of said water; and a tubing segment connected to one end of said flow control chamber and aligned in said bowl for directing said conveyance of water tangentially onto the surface of said bowl.

6. Apparatus according to claim 5, further includes an offset bracket received between the pivotal mounting of said seat and said toilet bowl.

7. Apparatus according to claim 6, further comprising:

at least one spring connected to said toilet seat for opposing the return pivotal motion thereof onto said bowl.

8. Apparatus according to claim 7, wherein:

said bellows spring is mounted to displace said seat from said vertical position upon the venting thereof.

9. Apparatus according to claim 8, wherein:

said angle piece is adjustably fixed to oppose the extension of said bellows spring upon the venting thereof when said seat is raised to a said vertical position.

10. Apparatus according to claim 9, wherein:

said angle piece is received between said seat and the pivotal mounting of said seat to said toilet bowl.

* * * * *